US005657872A

United States Patent [19]

Leftwich et al.

[11] Patent Number: 5,657,872

[45] Date of Patent: Aug. 19, 1997

[54] SHIPPING/DISPLAY CONTAINER

[75] Inventors: Robert Blake Leftwich, Boling Brook, Ill.; Linda Susan Matthews, Fairfield; Timothy Paul Burda, Cincinnati, both of Ohio

[73] Assignees: The Procter & Gamble Company, Cincinnati, Ohio; Stone Container Corporation, Chicago, Ill.

[21] Appl. No.: 384,185

[22] Filed: Feb. 6, 1995

[51] Int. Cl.[6] ..... B65D 77/30

[52] U.S. Cl. ..... 206/738; 206/766; 229/122; 229/240

[58] Field of Search ..... 206/44 R, 44.12, 206/45.12, 427, 429, 431–433, 497, 738, 766; 229/122, 243, 244, 245, 240

[56] References Cited

U.S. PATENT DOCUMENTS

| | | | |
|---|---|---|---|
| 1,991,640 | 2/1935 | Taylor | 217/3 |
| 2,152,079 | 3/1939 | Mott | 206/45.12 |
| 2,330,691 | 9/1943 | Darrow | 229/51 |
| 2,660,362 | 11/1953 | Schilling | 229/35 |
| 2,934,252 | 4/1960 | Wickstrom | 229/35 |
| 3,372,794 | 3/1968 | Kohlhaas | 206/44 |
| 3,425,544 | 2/1969 | Ayer et al. | 206/45.33 |
| 3,486,612 | 12/1969 | Kivell | 206/46 |
| 3,533,549 | 10/1970 | Gilchrist | 206/427 |
| 3,784,082 | 1/1974 | Hurlock | 229/30 |
| 3,870,221 | 3/1975 | Zeitter | 229/16 D |
| 3,892,348 | 7/1975 | Rohner | 229/23 R |
| 3,935,943 | 2/1976 | Meyer et al. | 206/45.34 |
| 4,000,811 | 1/1977 | Hardison et al. | 206/44 R |
| 4,003,514 | 1/1977 | Graser | 229/34 HW |
| 4,058,206 | 11/1977 | Morse et al. | 206/44 R |
| 4,113,100 | 9/1978 | Soja et al. | 206/602 |
| 4,183,436 | 1/1980 | Engelhardt et al. | 229/122 |
| 4,185,763 | 1/1980 | Geraedts | 229/15 |
| 4,191,288 | 3/1980 | Hostad | 206/45.22 |
| 4,263,769 | 4/1981 | Hanazawa et al. | 53/448 |
| 4,427,108 | 1/1984 | Coles | 206/497 |
| 4,533,052 | 8/1985 | Fruchey et al. | 206/602 |
| 4,565,316 | 1/1986 | Jes | 229/122 |
| 4,635,795 | 1/1987 | DeFlander et al. | 206/526 |

(List continued on next page.)

FOREIGN PATENT DOCUMENTS

| | | |
|---|---|---|
| 0157742 | 10/1985 | European Pat. Off. . |
| 0178717 | 4/1986 | European Pat. Off. . |
| 0235852 | 9/1987 | European Pat. Off. . |
| 2196273 | 3/1974 | France . |
| 2498561 | 7/1982 | France . |
| 382645 | 12/1964 | Switzerland . |
| 1141676 | 1/1969 | United Kingdom . |
| 2008542 | 6/1979 | United Kingdom . |

*Primary Examiner*—Jimmy G. Foster

*Attorney, Agent, or Firm*—William Scott Andes; E. Kelly Linman; Jacobus C. Rasser

[57] ABSTRACT

The present invention provides a shipping/display container which includes a tray portion having a bottom panel, two opposed end panels, and two opposed side panels One of the side panels comprises a float side panel and the other of the side panels comprises a rear side panel. The container further includes a cover portion attached to the container and disposed so as to engage the end panels and the side panels. More particularly, the front side panel includes a line of weakness defining a severable portion of the front side panel which extends in at least an intermediate portion downward to the lowermost edge of the front side panel. The severable portion includes a preformed aperture located adjacent to the lowermost edge of the front panel for initiating removable of the severable portion. Because the severable portion, at least in its center region, is preferably completely removed down to the bottom panel, products may be extracted from the resulting opening even though other containers or articles may be stacked both above and below the subject container limiting the ability to extract packages at an angle. In a particularly preferred embodiment, the lower edge of the cover portion is disposed in overlying relation to the aperture to facilitate simultaneous grasping of the severable portion and lower edge of the cover portion.

27 Claims, 6 Drawing Sheets

U.S. PATENT DOCUMENTS

| | | | |
|---|---|---|---|
| 4,813,545 | 3/1989 | Chung et al. | 206/621 |
| 4,865,187 | 9/1989 | Zulauf et al. | 206/45.31 |
| 4,871,067 | 10/1989 | Valenti | 206/427 |
| 4,911,305 | 3/1990 | Chung et al. | 206/628 |
| 4,979,621 | 12/1990 | Chung | 206/625 |
| 5,277,360 | 1/1994 | DeMott | 229/122 |
| 5,350,111 | 9/1994 | Vosbikian | 229/162 |

SHIPPING/DISPLAY CONTAINER

FIELD OF THE INVENTION

The present invention relates to containers which may be used for shipping a plurality of products and then converted to display the products for individual sale. The present invention further relates to such containers which provide for improved product access in the display mode.

BACKGROUND OF THE INVENTION

When transporting finished products from the point of manufacture to the point of sale, or to an intermediate storage facility, it is often desirable to enclose a quantity of products within a larger, more durable container. Not only does this preserve the products in their desired, saleable condition, but it minimizes the number of individual items to be handled and generally provides more uniformly shaped items for stacking and handling.

Through the years such containers have frequently taken the form of conventional, often rectangular, corrugated cardboard cartons having dimensions suitable for enclosing a predetermined number of finished products. While such containers have proven effective in protecting the finished products during transport and storage, they are generally inappropriate for retail display and the conventional approach involves removing the individual product items from the container and placing them individually on store shelving.

In an effort to provide a container more suitable for displaying products in a retail setting, containers have been developed which are convertible to a more open display configuration upon reaching the point of sale. Containers of this variety include those of a generally tray-like configuration with a removable cover. Although art-improvement over conventional corrugated containers, these containers still offer somewhat limited product access, particularly when such containers are in the midst of a stack of containers extending above and below.

Accordingly, it would be desirable to provide a container which is suitable for shipping a plurality of products, yet provides for improved product access in a display setting. It would be further desirable to provide such a container which is easy to open and economical in its construction, yet durable in service.

SUMMARY OF THE INVENTION

The present invention provides a shipping/display container which includes a tray portion having a bottom panel, two opposed end panels, and two opposed side panels One of the side panels comprises a front side panel and the other of the side panels comprises a rear side panel. The container further includes a cover portion attached to the container and disposed so as to engage the end panels and the side panels. More particularly, the front side panel includes a line of weakness defining a severable portion of the front side panel which extends in at least an intermediate portion downward to the lowermost edge of the front side panel. The severable portion includes a preformed aperture located adjacent to the lowermost edge of the front panel for initiating removable of the severable portion.

Because the severable portion, at least in its center region, is preferably completely removed down to the bottom panel, products may be extracted from the resulting opening even though other containers or articles may be stacked both above and below the subject container limiting the ability to extract packages at an angle. Accordingly, removable of the severable portion leaves an opening in the side of the container with a dear height substantially equal to the interior height of the container such that products or packages contained therein may be readily removed. This attribute is particularly important where the product or products are arranged within the container such that they have a height substantially equal to the internal height of the container.

In a particularly preferred embodiment, the lower edge of the cover portion is disposed in overlying relation to the aperture to facilitate simultaneous grasping of the severable portion and lower edge of the cover portion.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
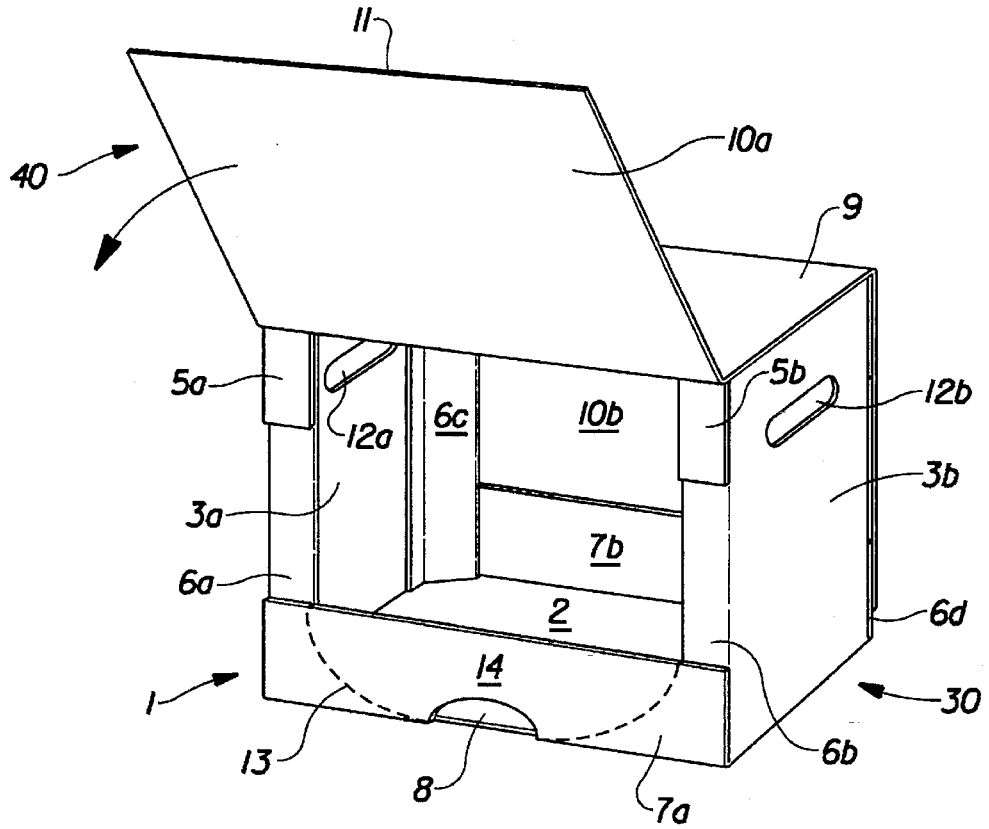
FIG. 1 is a perspective view of a container according to the present invention in a partially assembled condition.

FIG. 1 illustrates a container 1 constructed in accordance with the present invention. Container 1 includes a tray portion 30 and a cover portion 40. FIG. 1 depicts container 1 in a partially assembled condition, i.e., with cover portion 40 partially installed on tray portion 30, in order to more dearly depict the various structural features of container 1. It should be noted that FIG. 1, as well as FIGS. 2–5, depict container 1 in various configurations all of which have contents of the container omitted in the interest of clarity.

Tray portion 30 includes a bottom panel 2, end panels **3*a* and 3*b*, and side panels 7*a* and 7*b*. Side panel 7*a* comprises a front side panel, while side panel 7*b* comprises a rear side panel. End panels 3*a* and 3*b* each preferably, but optionally, include hand holes 12*a* and 12*b*, respectively, to facilitate handling of the container 1, particularly when in a loaded condition. Tray portion also includes reinforcing corner pillars or corner posts 6***a*, 6*b*, 6*c*, and 6*d* at the juncture of each pair of end and side walls. Although such corner posts could be omitted for certain applications, corner posts are preferably included to provide enhanced structural integrity to the tray portion 30. Corner posts 6*a*–6*d* may take on a variety of cross sections, although the triangular cross section depicted is presently preferred to maximize their resistance to deformation. Corner posts suitable for use in containers according to the present invention are described in greater detail in published European Patent Application 0,235,852, published Sep. 9, 1987, and U.S. Pat. No. 4,635,795, issued Jan. 13, 1987, the disclosures of which are incorporated herein by reference. End panels 3*a* and 3*b* preferably include inwardly extending flanges 4*a* and 4*b*, respectively at their upper ends for supporting the cover portion 40, and tabs 5*a*, 5*b*, 5*c*, and 5*d* for securing the flanges in their assembled position.

Cover portion 40 includes top panel 9, front panel 10*a*, and rear panel 10*b*. Top panel 9 is preferably substantially the size of bottom panel 2. Front and rear panels 10*a* and 10*b* are preferably substantially the length of front and rear side panels 7*a* and 7*b*, and are preferably slightly less than the full height of end panels 3*a* and 3*b* for a reason to be discussed below.

Of particular importance in providing the advantages of the present invention is the design of the front side panel 7*a*. As depicted in FIG. 1, the front side panel 7*a* includes a line of weakness 13 preferably generally centered in the front side panel. The line of weakness 13 preferably has its ends located proximate the corner posts at each end of the front side panel and its midpoint located substantially adjacent the juncture of the lower edge of the front side panel 7*a* and the bottom panel 2. Line of weakness 13 defines a severable portion 14 which comprises the portion of front side panel 7*a* between the line of weakness and the opening above front side panel 7*a*. The weakening of the region of the front panel 7*a* which comprises the "line of weakness" may be accomplished by full or partial perforation of the front wall material, full or partial scoring thereof, partial severing, or any other suitable method known in the art, of which perforation is presently preferred (as depicted in the Drawing Figures). Whatever the method of forming the fine of weakness, the line of weakness preferably exhibits sufficient strength to survive shipping and handling of the container without premature rupture while remaining sufficiently easy to rupture to facilitate opening and leave a reasonably well defined opening upon removal of the severable portion 14.

The severable portion 14 of the front side panel 7*a* is preferably semi-circular in shape, i.e., with its upper edge defined by the upper edge of front panel 7*a* and its lower edge defined by an arcuate line of weakness 13, and also preferably includes an aperture 8 adjacent to the midpoint of the line of weakness. In a preferred configuration, as depicted in FIG. 1, the aperture 8 is preferably semi-circular in shape with its lower edge adjacent the bottom panel 2 and its midpoint extending upwardly into the severable portion 14 such that its upper edge is arcuate in shape. The aperture provides a means of grasping the edge of the severable portion and initiating the tearing or severing operation along the line of weakness.

Figure 2:
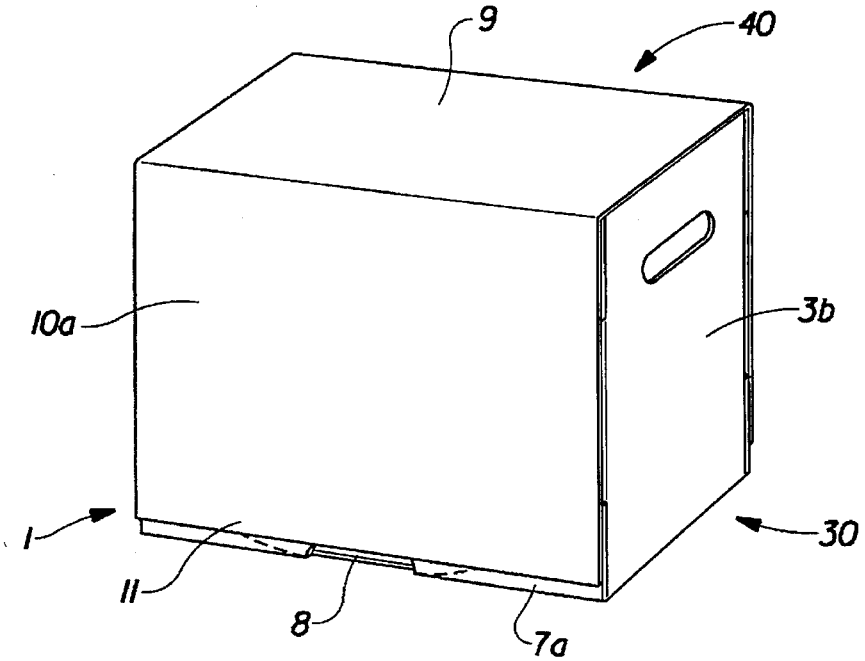
FIG. 2 is a perspective view of the container of FIG. 1 in a fully assembled condition.

FIG. 2 depicts the container 1 in a fully assembled condition, i.e., with cover portion 40 fully secured to tray portion 30. Cover portion 40 is preferably secured to tray portion 30 along two substantially continuous lines following the outermost edges of corner posts 6*a*–6*d* and across the top of flanges 4*a* and 4*b*. The interior of the container is thus substantially enclosed so as to contain and protect its contents during shipment and/or storage. Note that the lower edge 11 of the front panel 10*a* is located proximate the lower edge of the front side panel 7*a*, and preferably the lower edge 11 coincides with the aperture 8.

Figure 3:
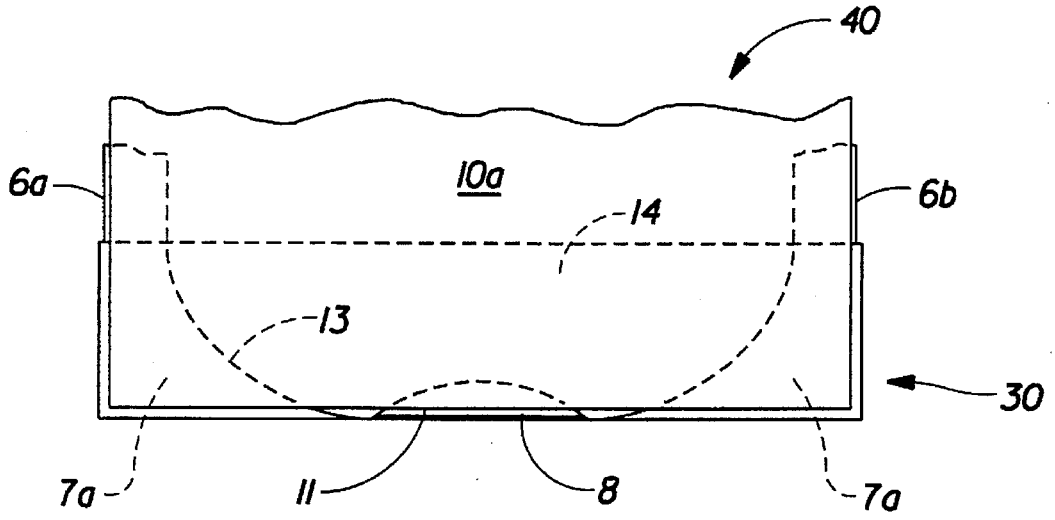
FIG. 3 is an enlarged, fragmentary view of the container of FIG. 1 illustrating the details of the opening features.

FIG. 3 is an enlarged view more dearly illustrating the relationship of the cover portion 30, the severable portion 14, and the aperture 8. As shown in FIG. 3, the exposed portion of the aperture 8 provides a visual cue to the consumer and/or customer as to the manner of initiating the removal of severable portion 14. In addition, suitable indicia (not shown) may be provided on front panel 10*a* to provide an enhanced visual cue.

Figure 4:
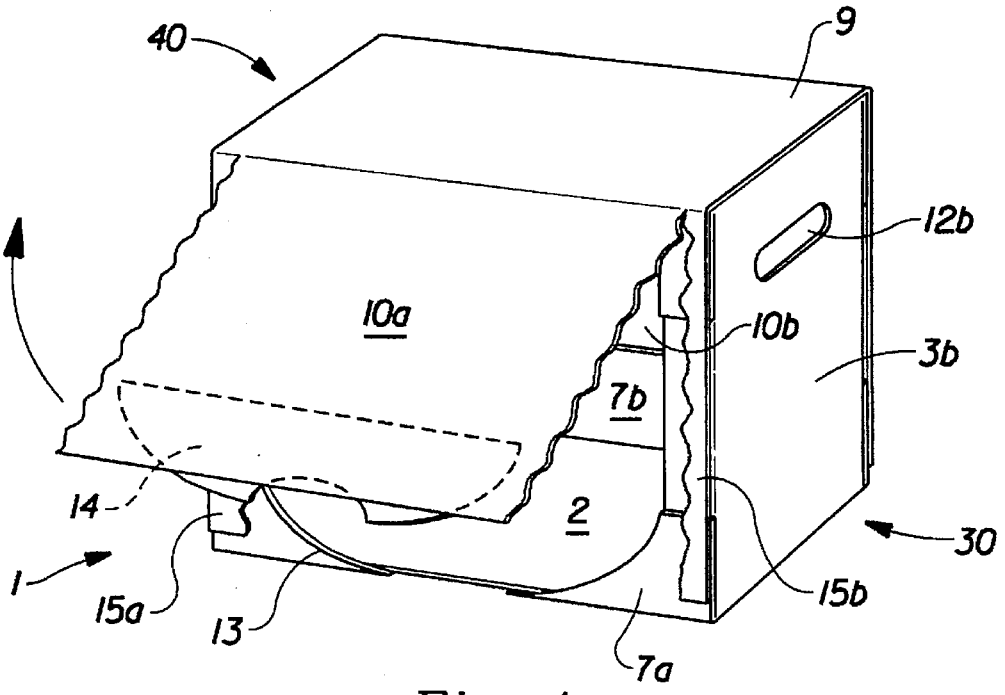
FIG. 4 is a perspective view of the container of FIG. 1 in a partially opened condition.

To open the container 1 for access to the products therein, the consumer or customer inserts one or more fingers into the aperture either below the lower edge 11 of the front panel 10*a* or tearing through the lower edge of the front panel 10*a* over the aperture 8. One or more fingers are then hooked around the lower edges of both the front panel 10*a* and the severable portion 14, and the consumer or customer pulls outwardly and upwardly so as to tear the severable portion free along the line of weakness 13. Simultaneously, the cover portion 40 is also tom along its attachment to the reinforced corner posts. FIG. 4 depicts the container 1 after this tearing open sequence has begun.

Figure 5:
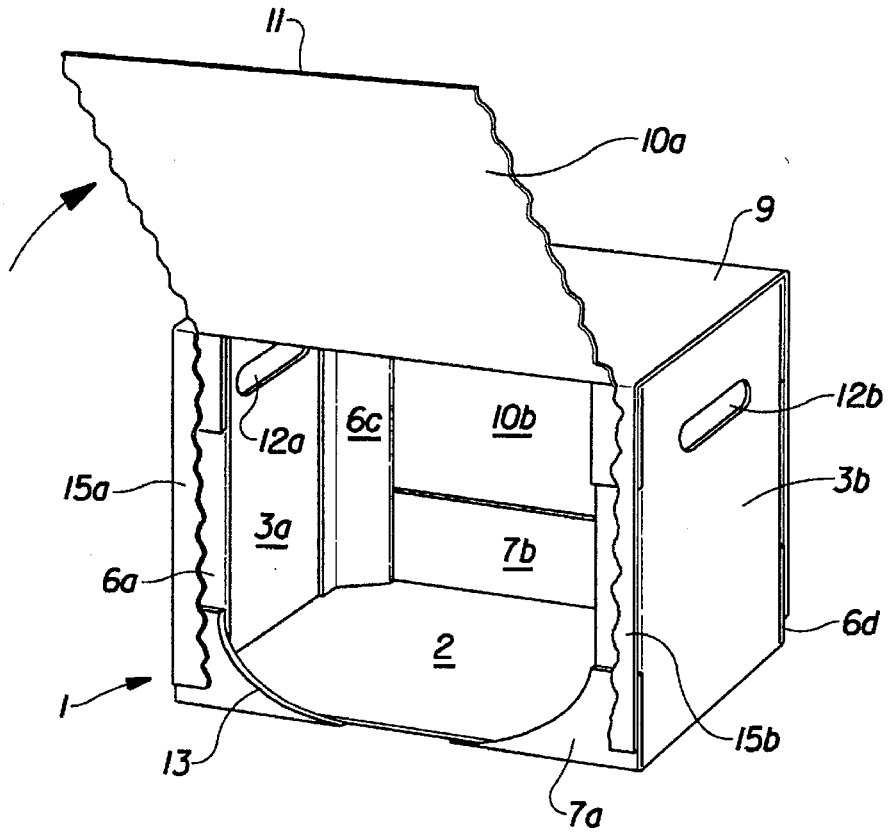
FIG. 5 is a perspective view of the container of FIG. 1 in a substantially opened condition.

The severable portion 14 and front panel 10*a* are tom upward until the severable portion is entirely free, and the front panel has been torn at least substantially toward the top panel portion of the overwrap as depicted in FIG. 5. At this point, the severable portion may be disposed of in a responsible manner, and the front portion of the overwrap may be left hingedly attached to the top panel portion or may be severed generally along its juncture with the top panel 9. Alternatively, it may be desirable to bond the severable portion 14 to the lower edge of the cover portion so that it remains attached to front panel 10*a*.

Because the severable portion, at least in its center region, is preferably completely removed down to the bottom panel, products may be extracted from the resulting opening even though other containers or articles may be stacked both above and below the subject container limiting the ability to extract packages at an angle. Accordingly, removable of severable portion 14 leaves an opening in the side of the container with a clear height substantially equal to the interior height of the container such that products or packages contained therein may be readily removed. This attribute is particularly important where the product or products are arranged within the container such that they have a height substantially equal to the internal height of the container.

Figure 6:
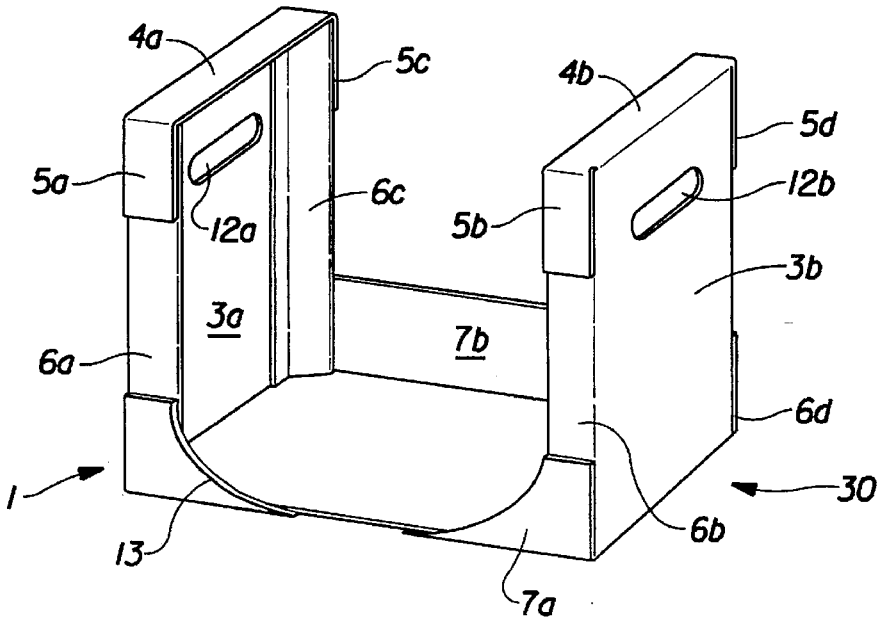
FIG. 6 is a perspective view of the container of FIG. 1 in a fully opened condition.

Alternatively, the tearing/opening operation may continue such that the cover portion continues to be torn along its peripheral attachment over the top of the container and down both edges of the back panel until it is completely torn free from the tray portion. At this point, the entire upper region of the tray portion is substantially open to provide complete product access. Such a fully open configuration is depicted in FIG. 6.

Note that, as best depicted in FIGS. 4 and 5, the tearing of the front panel 10*a* may leave behind thin strips of front panel material 15*a* and 15*b* which remain adhered to the corner posts 6*a* and 6*b*. Such strips of material may also extend over the flanges 4*a* and 4*b* and down the back side of corner posts 6*c* and 6*d*. In the interest of clarity, such strips are not depicted in FIG. 6.

To facilitate the tearing of the cover portion 40, particularly the front panel 10*a*, the cover material may be selected to have suitable tearing properties, particularly in the direction of the tearing depicted in the Drawing Figures. Alternatively, under some circumstances it may be desirable to provide tear initiating notches at the lower edge 11 of front panel 10*a* and/or provide preferential tearing zones in the cover portion 40 along the edges of the corner posts and flanges. Such preferential tearing zones may be defined by full or partial perforation of the cover material, full or partial scoring thereof, partial severing, or any other suitable method known in the art.

Figure 7:
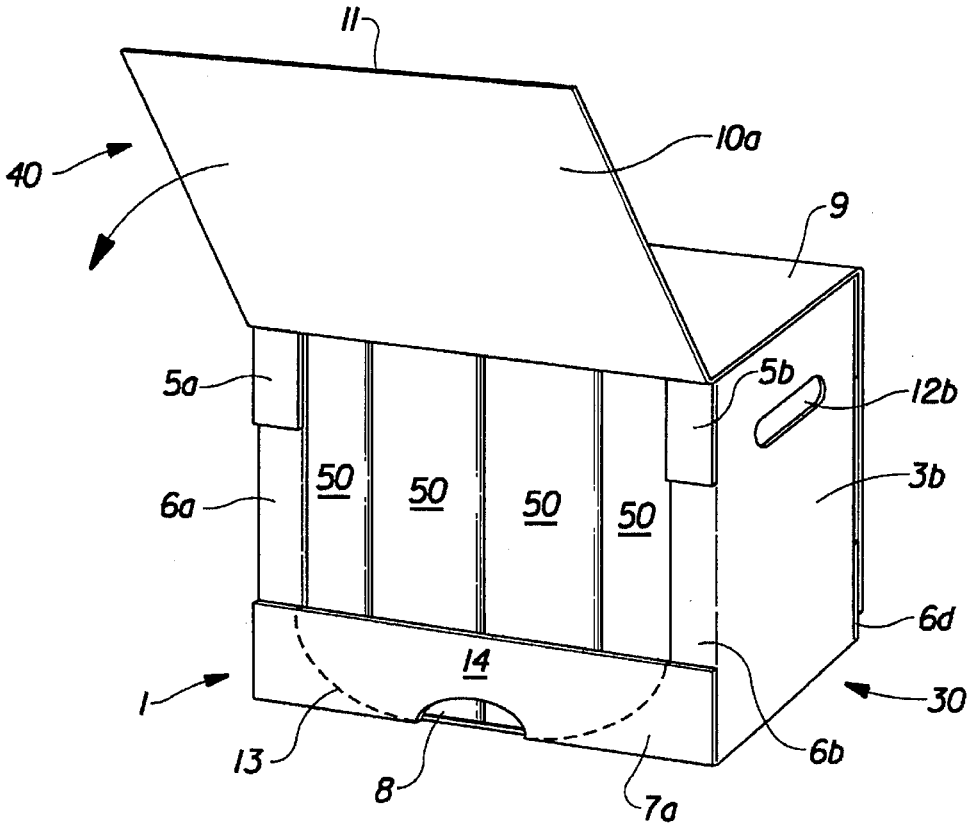
FIG. 7 is a perspective view of the container of FIG. 1 illustrating the placement of products inside the container.

FIG. 7 depicts the container 1 shown in FIG. 1 in a fully loaded configuration, i.e., with a plurality of products 50 inside of the container, just prior to closure. As shown in FIG. 7, the products preferably substantially fill the interior of the container in orderly fashion. Container 1 is particularly suited to contain products having a height substantially equal to the height of end walls 3*a* and 3*b*, although products of any size less than the overall interior volume of the container may be contained therein in any suitable orientation. With products arranged in a configuration such as depicted in FIG. 7, the removal of severable portion 14 would facilitate easiest removal of the more centrally located products 50, after which products located closer to end panels 3*a* and 3*b* (i.e., behind the remaining portions of front side panel 7*a*) could be more easily removed.

It should be understood that, as used herein, the term "product" is intended to encompass not only solid, individual items, but also individual containers which enclose a product or products in liquid, powdered, granular, particulate, or discrete forms. Accordingly, containers according to the present invention may contain a single individual product, but are particularly suitable for containing a plurality of products which may themselves be containers or carders of individual product units.

Figure 8:
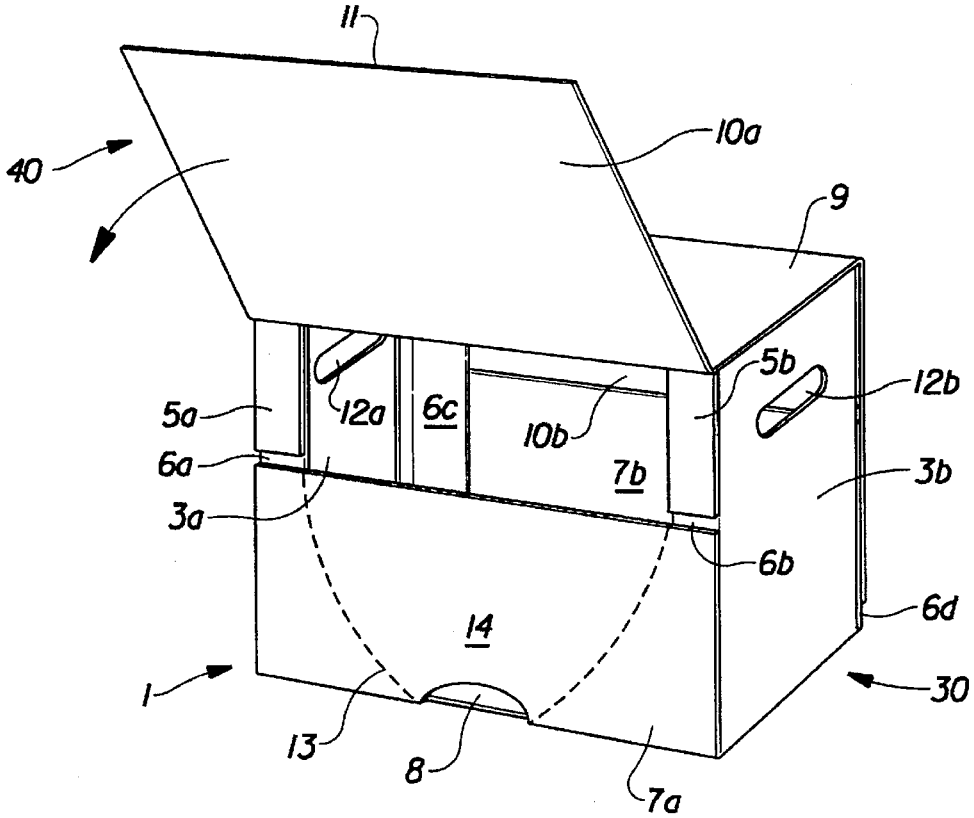
FIG. 8 is a perspective view of a container similar to that of FIG. 1, but depicting a variation in the proportions of the side panels.

The container may be constructed in any desired dimensions, depending upon the particular product or products to be contained therein. More particularly, the proportions of the container may likewise be varied as desired to suit the proportions of the products and the desired overall container shape. The portions of the container providing strength to the container may be altered to provide the desired attributes depending upon the weight of the products to be contained therein, as well as ultimate stacking heights, and other parameters. FIG. 8 depicts a container similar to that of FIG. 1, but having front and rear side panels 7*a* and 7*b* of greater height than those of FIG. 1. This configuration provides enhanced structural integrity and greater product retention following removal of the severable potion 14.

Figure 9:
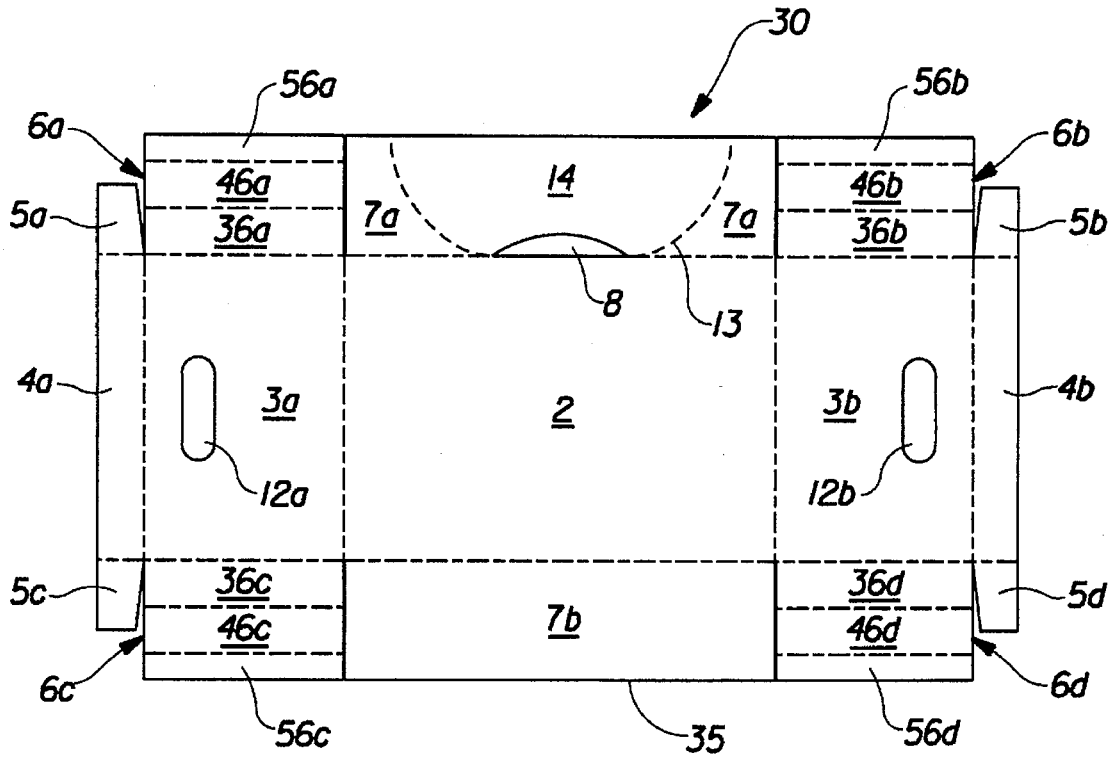
FIG. 9 is a plan view of a carton blank suitable for forming a container according to the present invention.
Figure 10:
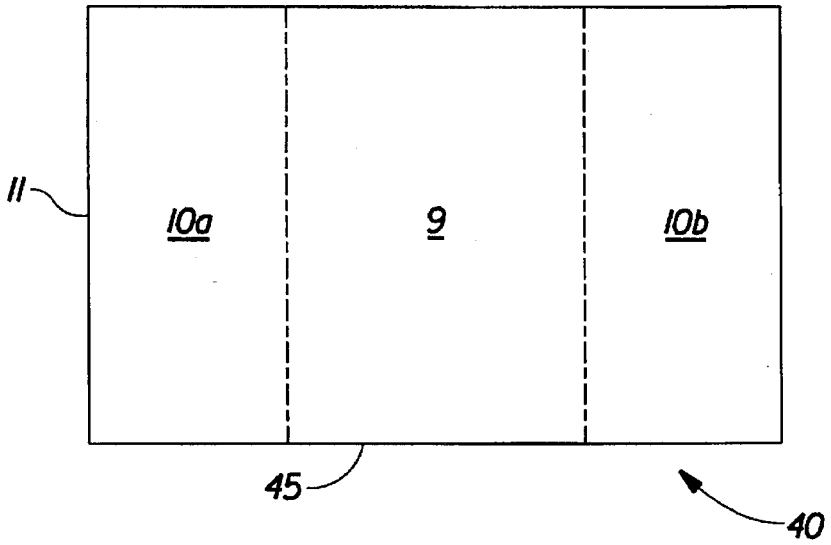
FIG. 10 is a plan view of a cover blank suitable for forming a container according to the present invention.

As depicted in FIGS. 1–8, the container is preferably (most desirably, but not necessarily) constructed from a unitary tray portion 30 and a unitary cover potion 40. Accordingly, FIG. 9 depicts a blank 35 suitable for forming a tray potion 30 according to the present invention, with fold lines illustrated and corresponding structural features corresponding to the container of FIG. 1 denoted by the appropriate numerals. FIG. 10 depicts a blank 45 suitable for forming a cover portion 40 according to the present invention, also having fold lines illustrated and corresponding structural features corresponding to the container of FIG. 1 denoted by the appropriate numerals.

Figure 11:
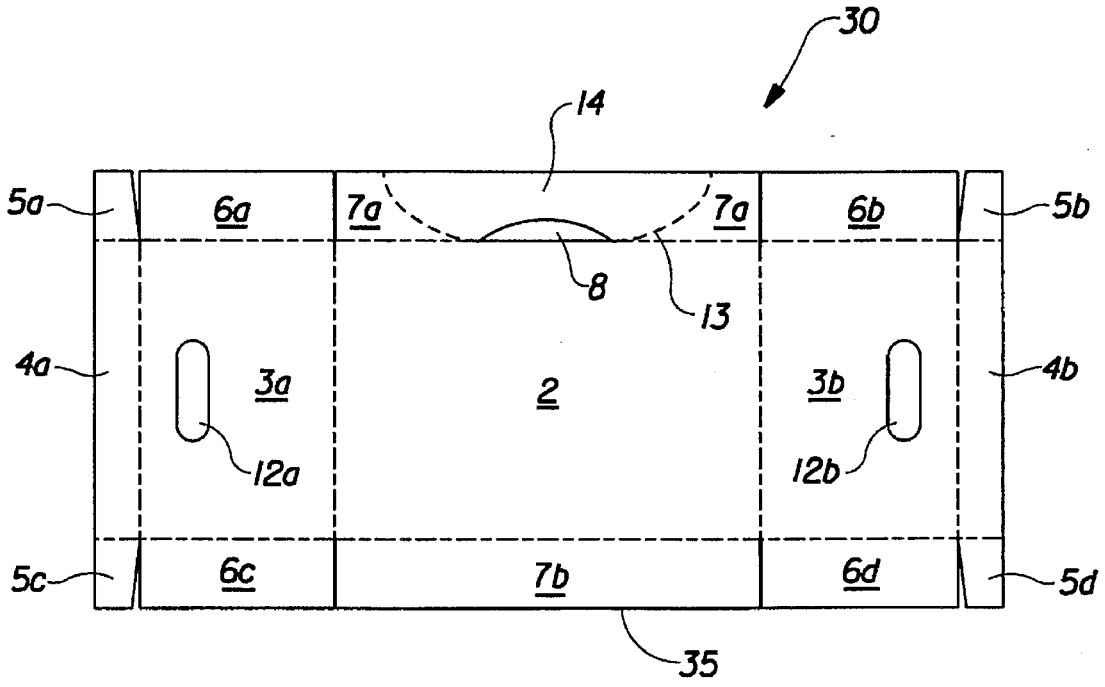
FIG. 11 is a plan view of a carton blank similar to that of FIG. 9 suitable for forming a container according to the present invention, but depicting a variation in the design of the comer posts.

Note that FIG. 9 more dearly depicts the components of corner posts 6*a*–6*d* prior to their folding. Each corner post, in the configurations illustrated in FIGS. 1–18, preferably has three surfaces to define a triangular cross section, as discussed above. Accordingly, each corner post 6*a*–6*d* comprises correspondingly numbered elements 36*a*–36*d*, 46*a*–46*d*, and 56*a*–56*d*, which remain hingedly attached along parallel edges and may be folded into the desired cross-sectional shape. FIG. 11 depicts a similar representative blank 35 having corner posts 6*a*–6*b* which comprise a single substantially planar element to provide a container of lighter construction where increased strength is not required.

The container, including tray portion 30 and cover portion 40, may be fabricated from a wide variety of suitable materials including, but not limited to, paper, cardboard (corrugated and otherwise), wood, metal, and plastic. For reasons of strength and economy, presently preferred materials for containers according to the present invention include corrugated cardboard for tray portion 30 and a heavyweight kraft paper for cover portion 40. Exemplary materials which have proven suitable for such uses are corrugated cardboard, 200 pound weight, for the tray portion, and kraft paper, 60 pound weight, for the cover portion.

Suitable means of joining tray portion 30 and cover portion 40, as well as securing tray portion 30 in its assembled condition, include tape, staples, and adhesives, of which hot melt adhesives are presently preferred. An exemplary adhesive which has proven suitable for such uses is a hot melt adhesive available from Adhesive Systems, Inc., as adhesive# 1221-M.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An improved shipping/display container, said container including a tray portion having a bottom panel with two end edges and two side edges, two opposed end panels each being associated with one of said end edges of said bottom panel, and two opposed side panels each being associated with one of said side edges of said bottom panel, one of said side panels comprising a front side panel and the other of said side panels comprising a rear side panel, said front side panel having an upper edge and a lower edge adjacent to said bottom panel, said container further including a cover portion attached to said container, said cover portion being disposed so as to engage said end panels and said side panels, said cover portion having a lower edge adjacent to said lower edge of said front side panel, the improvement comprising:

(a) said front side panel having a line of weakness with both ends located on said upper edge of said front side panel and an intermediate portion located along said lower edge of said front side panel, said line of weakness dividing said front side panel into a severable portion and two non-contiguous, non-severable portions, said severable portion including an aperture disposed proximate to said bottom edge of said front side panel, said lower edge of said cover portion being disposed in overlying relation to said aperture such that only a portion of said aperture is exposed.

2. An improved shipping/display container, said container including a tray portion having a bottom panel with two end edges and two side edges, two opposed end panels each being associated with one of said end edges of said bottom panel, and two opposed side panels each being associated with one of said side edges of said bottom panel, one of said side panels comprising a front side panel and the other of said side panels comprising a rear side panel, said front side panel having an upper edge and a lower edge adjacent to said bottom panel, the improvement comprising:

(a) said front side panel having a height less than the height of said end panels, said front side panel having a line of weakness with both ends located on said upper edge of said front side panel and an intermediate portion located along said lower edge of said front side panel, said line of weakness dividing said front side panel into a severable portion and two non-contiguous, non-severable portions, said line of weakness being configured to promote severance of said severable portion from said non-contiguous, non-severable portions along said line of weakness from said intermediate portion outwardly and upwardly toward said ends of said line of weakness such that a central portion of said front side panel is completely removed down to said bottom panel.

3. The improved shipping/display container of claim 2, wherein said line of weakness is arcuate.

4. The improved shipping/display container of claim 3, wherein said severable portion is semi-circular.

5. The improved shipping/display container of claim 2, wherein said end panels include hand holes.

6. The improved shipping/display container of claim 2, wherein said tray portion further includes reinforcing corner pillars.

7. The improved shipping/display container of claim 2, wherein said line of weakness comprises a line of perforation.

8. The improved shipping/display container of claim 2, wherein said end panels have a lower end attached to said bottom panel and an upper end located remotely from said bottom panel, and wherein said end panels further include an inwardly extending flange at said upper end.

9. The improved shipping/display container of claim 2, wherein at least said tray portion is formed from an integral blank of container material.

10. The improved shipping/display container of claim 2, wherein said severable portion includes an aperture disposed proximate to said bottom edge of said front side panel.

11. The improved shipping/display container of claim 10, wherein said aperture is preformed and semi-circular in shape.

12. The improved shipping/display container of claim 10, wherein said aperture is located adjacent to the midpoint of said line of weakness.

13. The improved shipping/display container of claim 2, wherein said container further includes a cover portion attached to said container, said cover portion being disposed so as to engage said end panels and said side panels, said cover portion having a lower edge adjacent to said lower edge of said front side panel.

14. An improved shipping/display container, said container including a tray portion having a bottom panel with two end edges and two side edges, two opposed end panels each being associated with one of said end edges of said bottom panel, and two opposed side panels each being associated with one of said side edges of said bottom panel, one of said side panels comprising a front side panel and the other of said side panels comprising a rear side panel, said front side panel having an upper edge and a lower edge adjacent to said bottom panel, said container further including a cover portion attached to said container, said cover portion being disposed so as to engage said end panels and said side panels, said cover portion having a lower edge adjacent to said lower edge of said front side panel, the improvement comprising:

(a) said front side panel having a height less than the height of said end panels, said front side panel having a line of weakness with both ends located on said upper edge of said front side panel and an intermediate portion located along said lower edge of said front side panel, said line of weakness dividing said front side panel into a severable portion and two non-contiguous, non-severable portions, said severable portion including an aperture disposed proximate to said bottom edge of said front side panel, said lower edge of said cover portion being disposed in overlying relation to said aperture.

15. The improved shipping/display container of claim 14, wherein said line of weakness is arcuate.

16. The improved shipping/display container of claim 5, wherein said severable portion is semi-circular.

17. The improved shipping/display container of claim 14, wherein said aperture is semi-circular.

18. The improved shipping/display container of claim 14, wherein said end panels include hand holes.

19. The improved shipping/display container of claim 14, wherein said tray portion further includes reinforcing corner pillars.

20. The improved shipping/display container of claim 14, wherein said line of weakness comprises a line of perforation.

21. The improved shipping/display container of claim 14, wherein said end panels have a lower end attached to said bottom panel and an upper end located remotely from said bottom panel, and wherein said end panels further include an inwardly extending flange at said upper end.

22. The improved shipping/display container of claim 14, wherein said aperture is preformed.

23. The improved shipping/display container of claim 14, wherein at least said tray portion is formed from an integral blank of container material.

24. The improved shipping/display container of claim 14, wherein at least said cover portion is formed from an integral blank of container material.

25. The improved shipping/display container of claim 14, wherein said lower edge of said cover portion is formed from a frangible material such that said lower edge of said cover portion may be ruptured to provide access to said aperture for initiating removal of said severable portion.

26. The improved shipping/display container of claim 14, wherein said aperture is located adjacent to the midpoint of said line of weakness.

27. The improved shipping/display container of claim 14, wherein said line of weakness is configured to promote severance of said severable portion from said non-contiguous, non-severable portions along said line of weakness from said intermediate portion outwardly and upwardly toward said ends of said line of weakness such that a central portion of said front side panel is completely removed down to said bottom panel.

* * * * *